US005772330A

United States Patent [19]

Bang et al.

[11] Patent Number: 5,772,330

[45] Date of Patent: Jun. 30, 1998

[54] TAMPER-EVIDENT BAG FOR PROTECTING LUGGAGE AND METHODS THEREOF

[75] Inventors: Scott M. Bang, Pillager; Kenneth E. Carney, Eden Prairie; Bruce M. Ancel, Bloomington; Thomas S. Everett, Burnsville; Lance M. Swenson, Bloomington, all of Minn.

[73] Assignee: Strout Plastics (div. of Great Pacific Enterprises (II)), Bloomington, Minn.

[21] Appl. No.: 747,888

[22] Filed: Nov. 13, 1996

[51] Int. Cl.[6] ..... B65D 33/18

[52] U.S. Cl. ..... 383/87; 383/207; 383/5; 150/154

[58] Field of Search ..... 383/87, 26, 27, 383/111, 84, 5, 207, 208, 209; 150/105, 154; 190/26

[56] References Cited

U.S. PATENT DOCUMENTS

| | | | |
|---|---|---|---|
| 2,842,179 | 7/1958 | Hoeppner | 383/87 |
| 3,510,052 | 5/1970 | Ruda | 383/11 |
| 4,572,377 | 2/1986 | Beckett | 383/204 X |
| 5,083,644 | 1/1992 | Collins, III | 150/154 X |
| 5,172,795 | 12/1992 | Riceman | 150/154 X |
| 5,293,975 | 3/1994 | Howorka | 150/154 X |
| 5,370,461 | 12/1994 | Smith et al. . | |

FOREIGN PATENT DOCUMENTS

| | | | |
|---|---|---|---|
| 1320387 | 1/1963 | France | 383/87 |
| 1486223 | 2/1969 | Germany | 383/87 |
| 2128164 | 4/1984 | United Kingdom | 383/87 |

OTHER PUBLICATIONS

Declaration of Kenneth E. Carney with Exhibits A–C No Date For Admitted Prior Art.

*Primary Examiner*—Jes F. Pascua
*Attorney, Agent, or Firm*—Merchant, Gould, Smith, Edell, Welter & Schmidt, P.A.

[57] ABSTRACT

A flexible bag for protecting luggage includes first and second opposing panel sections joined by a gusset at a first end. The first and second panel sections are secured together along first and second opposite edges with the gusset therebetween, to form a containment region between the first and second panel sections and bordered by the first and second edges and the gusset. A mouth is defined by the first and second panel sections at a second end opposite to the first end. The mouth is movable from an open position to a closed position, and provides access to the containment region when in the open position. A tamper-evident closure arrangement is at the mouth for securing the mouth in the closed position. The closure arrangement includes an adhesive region held by the second panel section, and a flap arrangement integral to the first panel section. The flap arrangement is constructed and arranged to fold over the mouth, engage the adhesive region, and completely secure the mouth in the closed position closing all access voids to the containment region. One useful application is for protecting luggage.

14 Claims, 3 Drawing Sheets

TAMPER-EVIDENT BAG FOR PROTECTING LUGGAGE AND METHODS THEREOF

FIELD OF THE INVENTION

This invention relates generally to a flexible bag. More particularly, this invention relates to a tamper-evident bag useful for protecting luggage, and methods for making and using the same.

BACKGROUND OF THE INVENTION

In recent times, there has been an increase in the amount of terrorist activities at airports. As bombs and plastic explosives become more sophisticated, smaller, and easier to conceal, there has been heightened concern about enhancing the safety of cargo, including luggage, loaded onto an airplane.

Similarly, passengers in airplanes have raised concerns about checking their luggage, particularly if it contains valuables. Pilfering through checked luggage in search of valuables by unscrupulous airport employees, or by intruders, has been known to occur with enough frequency to cause concern. Locks on luggage are not always an option, and can be inconvenient.

Another problem associated with checking luggage concerns its handling. If handled roughly, the luggage can sustain damage. At times, luggage contents including containers for holding liquid, can break and leak over several pieces of luggage.

Consequently, there is a need for a way to enhance the safety and protection of cargo, such as luggage, loaded onto an airplane. There is also a need for a way to ensure the security of checked luggage from unauthorized access.

SUMMARY OF THE INVENTION

The present invention is directed to a flexible bag for protecting luggage. To achieve the advantages of the invention and in accordance with the purposes of the invention, as embodied and broadly described herein, a flexible bag comprises first and second opposing panel sections joined by a gusset at a first end. The first and second panel sections are secured together along first and second opposite edges with the gusset therebetween, to form a containment region between the first and second panel sections and bordered by the first and second edges and the gusset. A mouth is defined by the first and second panel sections at a second end opposite to the first end. The mouth is movable from an open position to a closed position, and provides access to the containment region when in the open position. A tamper-evident closure arrangement is at the mouth for securing the mouth in the closed position. The closure arrangement includes an adhesive region held by the second panel section, and a flap arrangement integral to the first panel section. The flap arrangement is constructed and arranged to fold over the mouth, engage the adhesive region, and completely secure the mouth in the closed position closing all access voids to the containment region.

In certain arrangements, the flap arrangement includes a first flap and a first fold line. The first flap is sealed to the first and second edges along first and second seal regions. The first fold line joins the first flap and the first panel section. The first flap is constructed and arranged to pivot about the first fold line to permit the first flap to cover the mouth, when moving the mouth to the closed position.

Preferably, the flap arrangement further includes a second flap and a second fold line. The second flap is sealed to the first and second edges along the first and second seal regions. The second fold line joins the second flap to the first flap. The second flap is constructed and arranged to be movable across the mouth and unfold the second fold line to permit the first and second flaps to cover the mouth, when moving the mouth to the closed position.

Preferably, the flap arrangement further includes a third flap and a third fold line. The third flap is sealed to the first and second edges along the first and second seal regions. The third fold line joins the third flap to the second flap. The third flap is constructed and arranged to pivot about the third fold line to permit the first, second, and third flaps to cover the mouth, when moving the mouth to the closed position.

In some arrangements, the adhesive region includes an adhesive strip on the second panel section and extending an entire length between the first and second edges. In such arrangements, the third flap engages the adhesive strip, when the mouth is in the closed position.

The adhesive region may be located a first distance from the second end of the bag to define a band between the strip and the second end, and it may extend between the first and second seal regions. In those arrangements, the first, second, and third flaps are constructed and arranged to completely enclose the first and second seal regions, the band, and the adhesive strip when the mouth is in the closed position.

Preferably, the bag includes a perforated line in at least one of the first and second panel sections, and extending at least partially between the first and second edges. In other arrangements, the perforated line extends the length between the first and second edges.

The first and second panel sections and closure arrangement may comprise high density polyethylene, low density polyethylene, and/or co-extrusions. If co-extruded, a layer adjacent to the containment region may have a lower co-efficient of friction than a layer exposed to an outside environment.

In another aspect, the invention is directed to a combination of luggage and a disposable, tamper-evident flexible bag for protecting the luggage. The combination includes a piece of luggage, and a bag. The bag comprises first and second opposing panel sections joined by a gusset at a first end. The first and second panel sections are sealed together along first and second opposite edges with the gusset therebetween, to form a containment region between the first and second panel sections and are bordered by the first and second edges and the gusset. The containment region holds the luggage between the first and second edges and over the gusset. A mouth is defined by the first and second panel sections at a second end opposite to the first end. The mouth is in a closed position. A tamper-evident closure arrangement at the mouth seals the mouth in the closed position. The closure arrangement includes an adhesive region held by the second panel section, and a flap arrangement integral to the first panel section. The flap arrangement is folded over the mouth and engaged with the adhesive region to completely seal the mouth in the closed position closing all access voids to the containment region and the luggage.

Preferably, the flap arrangement includes a plurality of flaps sealed to the first and second edges at first and second seal regions. The adhesive region preferably includes an adhesive strip extending between the first and second seal regions. The plurality of flaps is preferably folded over the mouth to completely enclose the first and second seal regions, and the adhesive strip, thereby preventing access to the luggage.

Preferably, the bag includes a perforated line in at least one of the first and second panel sections, and extending at least partially between the first and second edges.

In another aspect, the invention is directed to a method for protecting luggage. The method includes the steps of providing a bag including a containment region and a mouth providing access to the containment region; placing a piece of luggage in the containment region of the bag by passing the luggage through the mouth; and completely sealing the mouth in a closed position to close all access voids to the containment region, and thereby prevent access to the luggage.

Preferably, the step of providing a bag includes providing a bag having a perforation line. After the step of completely sealing the mouth, the method includes tearing along the perforation line in order to access the luggage, and disposing of the bag.

In certain applications, the step of providing a bag includes providing a bag comprising first and second panel sections sealed together along first and second edges. The bag includes a plurality of flaps sealed to the first and second edges at first and second seal regions. An adhesive strip extends between the first and second seal regions. The step of completely sealing the mouth may include folding the plurality of flaps over the mouth to engage the adhesive strip and completely enclose the first and second seal regions, and the adhesive strip.

In another aspect, the invention is directed to a method for making a flexible bag. The method comprises the step of providing a film of a polymeric material having first and second edges. The film is folded to form first and second opposed panel sections and a gusset region therebetween, the first panel section being longer than the second panel section at an extended region. The extended region is folded into first, second, and third flaps joined by first, second, and third fold lines. The first and second panel sections are heat sealed together along the first and second edges. An adhesive strip is added to the second panel section.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention. In the drawings:

DETAILED DESCRIPTION OF THE PREFERRED EMBODIMENTS

Reference will now be made in detail to the present preferred embodiments of the invention, an example of which is illustrated in the accompanying drawings. Whenever possible, the same reference numbers will be used throughout the drawings to refer to the same or like parts.

In accordance with the invention, the invention includes a flexible bag for protecting luggage. The bag has a containment region for holding a piece of luggage. The bag includes a tamper-evident closure arrangement. After the luggage is inserted in the bag, the closure arrangement completely seals the bag closed. There are no access voids. It is tamper-evident in that there is no way to access the luggage without obviously tearing or ripping the bag. In order to remove the luggage from the bag, the bag may be ripped open along a perforation line, and then discarded.

Figure 1:
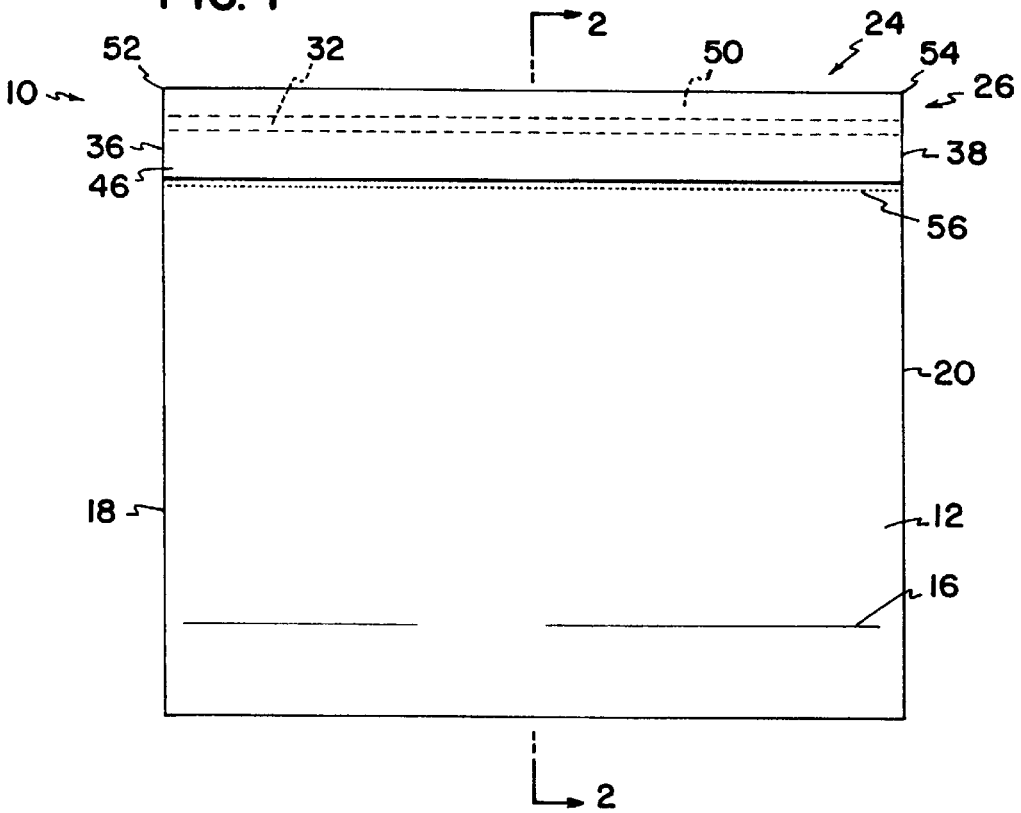
FIG. 1 is a plan view of an embodiment of a flexible bag, according to the present invention.
Figure 2:
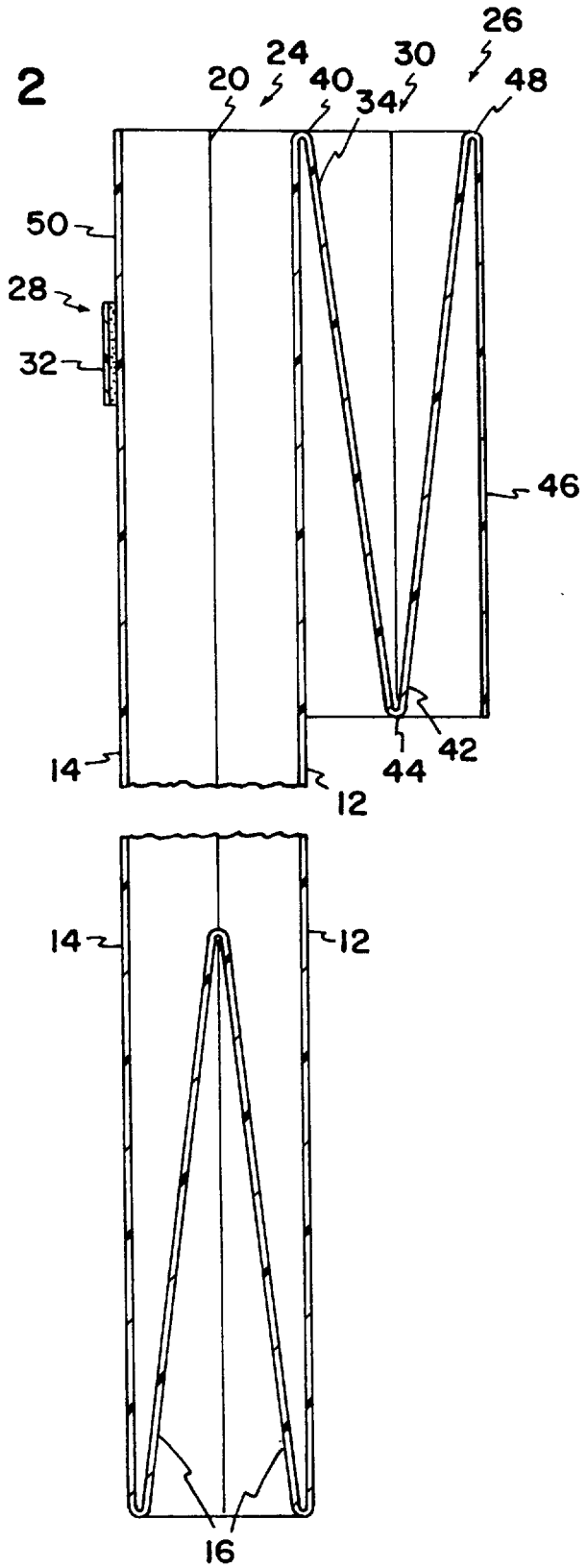
FIG. 2 is a fragmented, cross-sectional view taken along the line II—II of FIG. 1 of an embodiment of a flexible bag, according to the present invention.
Figure 3:
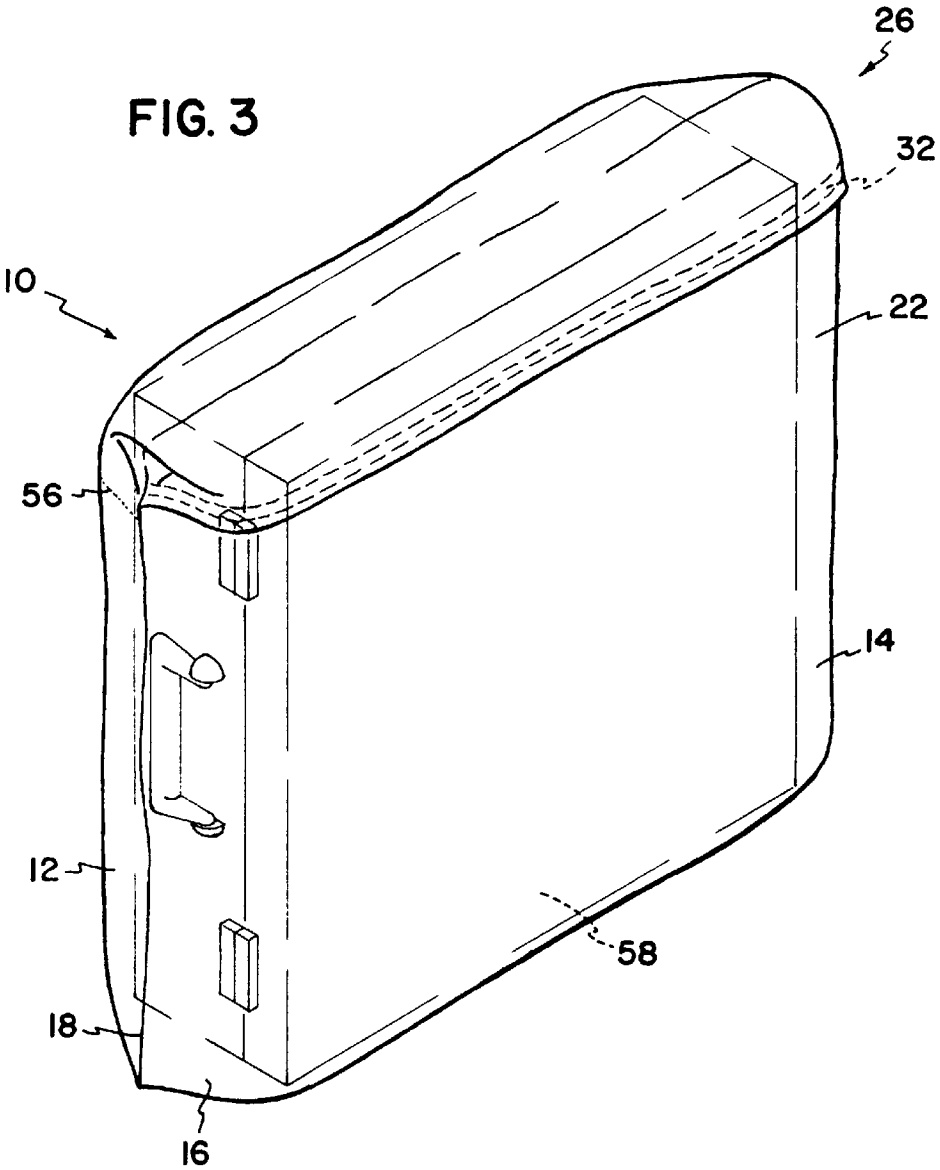
FIG. 3 is a perspective view of an embodiment of a flexible bag, according to the present invention.

One embodiment of a flexible bag according to the invention is illustrated in FIGS. 1 and 3 generally at 10. Bag 10 includes a first panel section 12, and a second panel section 14. As illustrated in FIG. 2, first and second panel sections 12, 14 oppose each other and are joined by a gusset 16 at a first end. In a typical usage, gusset 16 would be oriented toward the bottom of bag 10.

First and second panel sections 12, 14 are secured together along a first edge 18 and a second edge 20. In the particular illustrated embodiment, bag 10 is rectangular in shape, so first and second edges 18, 20 are opposite and parallel to each other. Gusset 16 extends between first and second edges 18, 20. Together, first and second panel sections 12, 14 form a containment region 22 (FIG. 3) which is bordered by first and second edges 18, 20 and gusset 16. Containment region 22 functions to hold and contain whatever is being inserted into the bag 10. As explained herein, bag 10 is particularly suited to containing luggage. However, it should be understood that it is contemplated that bag 10 can be used for holding other items as well.

A mouth 24 is defined by first and second panel sections 12, 14 at a second end. The second end may be the end opposite to the first end where gusset 16 is located. Mouth 24 is movable from an open position, illustrated in FIG. 2, to a closed position, illustrated in FIGS. 3 and 4. Mouth 24 functions to provide access to containment region 22 when mouth 24 is in the open position, FIG. 2.

In accordance with the invention, the flexible bag includes a tamper-evident closure arrangement at the mouth for securing the mouth in the closed position. One function of the tamper-evident closure arrangement is to ensure that a secure and tight closure is provided, which will prevent any unauthorized access to the contents in the containment region. In the particular embodiment illustrated, a tamper-evident closure arrangement 26 includes an adhesive region 28 and a flap arrangement 30.

Adhesive region 28 may be secured to second panel section 14. The nature of adhesive region 28 is such that once it is engaged with flap arrangement 30, it may not be unsealed without ripping the bag. One particularly advantageous adhesive region 28 includes an adhesive strip 32 extending the entire length from first edge 18 to second edge 20. Adhesive strip 32 is located a certain distance from the second end of bag 10 to define a band 50, FIG. 2, between adhesive strip 32 and the second end. One preferred adhesive strip includes a double sided tape, such as a double coated clear polypropylene film tape incorporating a 100% plastic film release liner. Such tape is available from International Tape Company of Windham, N.H.

Flap arrangement 30 may be integral to, that is a continuous part of, first panel section 12. Flap arrangement 30 is constructed and arranged to fold over mouth 24, engage adhesive region 28, and completely secure mouth 24 in the closed position and close all access voids to containment region 22. That is, through the cooperation of flap arrangement 30 and adhesive region 28, bag 10 may be completely sealed shut preventing any and all access to the contents of bag 10. In the specific embodiment illustrated, flap arrangement 30 includes a first flap 34 sealed to first and second edges 18, 20 along first and second seal regions 36, 38 in the upper portion of bag 10. That is, first and second sealed regions 36, 38 are in the region of the bag in generally the upper one-fourth of the bag when the bag is oriented in a position as illustrated in FIG. 1. A first fold line 40 join first flap 34 to the first panel section 12. First flap 34 pivots about first fold line 40 to permit first flap 34 to cover mouth 24, when a user moves the mouth to the closed position.

In the embodiment illustrated, flap arrangement 30 also includes a second flap 42 also sealed to first and second edges 18, 20 along first and second seal regions 36, 38. That is, second flap 42 overlaps first flap 34 and is sealed to first flap 34 along the first and second edges 18, 20. A second fold line 44 joins second flap 42 to first flap 34. Second flap 42 is constructed and arranged to be moveable across mouth 24 and unfold second fold line 44 to permit both first flap 34 and second flap 42 to cover mouth 24, when a user moves mouth 24 to the closed position.

Also shown in this particular illustrated embodiment, flap arrangement 30 further includes a third flap 46 overlapping the first flap 34 and the second flap 42. Third flap 46 is sealed to the first and second flaps along first and second seal regions 36, 38. A third fold line 48 joins third flap 46 to second flap 42. Third flap 46 is constructed and arranged to pivot about third fold line 48 to permit first flap 34, second flap 42, and third flap 46 to cover mouth 24, when a user moves mouth 24 to the closed position. As illustrated in FIG. 2, the first, second, and third flaps resemble an accordion which is expandable from a substantially flat configuration to an expanded configuration. When flap arrangement 30 is used to secure bag 10 in the closed position, third flap 46 engages adhesive region 28. Preferably, third flap 46 is adhered to adhesive strip 32 along the entire length between first edge 18 and second edge 20.

Figure 4:
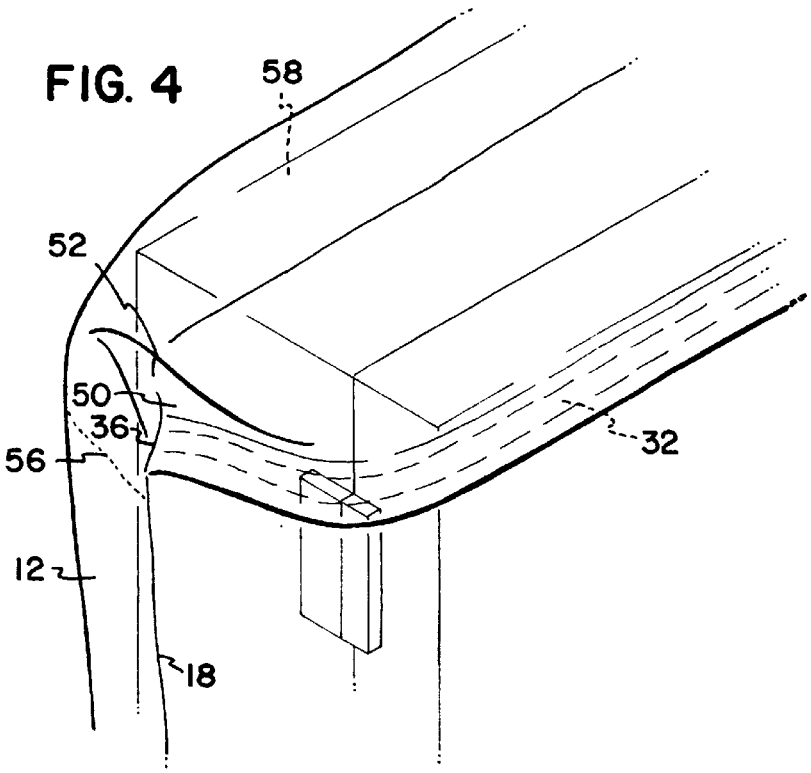
FIG. 4 is a fragmented, perspective view of a corner of the FIG. 3 embodiment, according to the present invention.

The closure arrangement 26 provides a complete closure and a blocking of any access voids to the containment region of the bag. One example of this is illustrated in FIG. 4. When closure arrangement 26 is used to seal bag 10 in its closed position, the first, second, and third flaps 34, 42, 46, are folded over mouth 24 to allow third flap 46 to engage adhesive strip 32 from first edge 18 to second edge 20. When engaged in this manner, flap arrangement 30 completely encloses first and second seal regions 36, 38, band 50, and adhesive strip 32. Therefore, all access to containment region 22 is blocked because there are no voids in the bag. Flap arrangement 30, when moved to the closed position, folds over first and second corners 52, 54. Because the first, second, and third flaps are sealed at first and second seal regions 36, 38, when third flap 46 is engaged with adhesive strip 32, there is no void or hole through closure arrangement 26 to containment region 22. This is advantageous, in that if there were voids, unauthorized access could still be gained to containment region by penetrating the voids.

In accordance with the invention, the flexible bag includes a perforation in at least one of the first and second panel sections. As embodied herein, a perforation line 56 is included in first panel section 12. Perforation line 56 extends the entire length between first and second edges 18, 20. In other embodiments, perforation line 56 does not extend the entire length between the first and second edges, but only extends a partial length between the first and second edges. For example, in other embodiments, a perforation line may have a length (as compared with the entire length between the first and second edges) of one third or less of that length, and centered toward a middle portion of the bag. Other lengths and locations of the perforation may be used as well.

One function of perforation 56 is to assist the user in opening bag 10 after it has been sealed closed by closure arrangement 26. Perforation 56 provides for a weakened area of film, so that the user may grasp the bag and tear along the perforation 56.

One application for a flexible bag in accordance with the invention is for protecting a piece of luggage. As illustrated in FIG. 3, bag 10 may be used to contain a piece of luggage 58. Luggage 58 is held by bag 10 within containment region 22, and is sealed shut with closure arrangement 26. In preferred arrangements, bag 10 is made of a transparent material, such that luggage 58 is easily identified through bag 10. Bag 10 may be in a variety of sizes in order to accommodate the various sizes of luggage 58. In certain preferred arrangements, adhesive strip 32 is color coded based upon the size of bag 10. This may be advantageous to the bag handlers at the airport when loading and unloading luggage into the cargo area of the airplane.

In operation, one method of using the bag of the present invention is as follows: A piece of luggage to be protected from unauthorized access is provided. For example, an airline passenger at the check-in counter of an airport presents his luggage for checking.

Next, a bag including a containment region and a mouth providing access to the containment region is provided. One preferred bag is of the type which is illustrated in the FIGS. at 10. Based upon the size of the luggage to be protected, the appropriate sized bag is selected. In certain preferred arrangements, the bag sizes are coded based upon the colors of the adhesive strips.

Next, the luggage is passed through the mouth of the bag and into the containment region. It is appropriately positioned, for example, resting over the bottom gusset and with the closure arrangement positioned well above the end of the luggage.

Next, the mouth is moved to the closed position, and is completely sealed to close all access voids to the containment region. Preferably, this step is accomplished by a flap arrangement such as that illustrated at 30 in FIG. 2, and folding the plurality of flaps over the mouth to completely close the mouth. In certain preferred arrangements, the adhesive strip used is double stick tape. In such arrangements, the protective cover for the adhesive strip should be removed in order to allow the flap arrangement to engage and stick to the adhesive strip across the bag. This step should then result in luggage being completely protected from unauthorized intrusion and from spills and leaks. It also protects the luggage from various abrasions and scuffs from rough handling.

Preferably, the luggage with the protective bag is then loaded into the cargo area of an airplane. The baggage handlers may look at the color of the adhesive strip to help gage the size and assist in more efficient loading.

At the conclusion of the flight, the luggage in the protective bags is unloaded, and placed upon the luggage carousel. In preferred arrangements, the bag is transparent to aid passengers in claiming their luggage.

After the passenger finds his luggage, the passenger removes his luggage from the bag and disposes of the bag. Preferably, the bag includes a perforation line. In such applications where the bag includes a perforation line, the step of removing the luggage from the bag includes tearing along the perforation line in order to access the luggage. Preferably, the bag is made from a recyclable material, so that the step of disposing of the bag includes placing it in an appropriate recycling bin.

Preferred materials for a bag according to the present invention may include a polymeric material. This polymeric material may include a high density polyethylene, or a low density polyethylene. Suitable polyethylene is available from Nova Chemicals, Calgary, Alberta, Canada, or Lyondell Polymers, Houston, Tex.

In certain preferred arrangements, the bag may be made in multiple layers through coextrusion. In these multiple layered bags, there are at least three layers and can be more layers depending upon the functions desired. The coextrusion provides the advantageous feature of a dual slip property. For example, the layer intimate with the containment region of the bag, i.e., the layer which comes in contact with the luggage, may have a low coefficient of friction. This allows luggage to be easily loaded into the bag. On the other hand, the layer on the outside of the bag, that is, the layer which will come into contact with the baggage handlers, may be constructed with a high coefficient of friction to provide a tacky surface conducive to gripping and handling. In these arrangements, there is at least a middle layer which may be formed from a recycled or a virgin polyethylene material. One suitable coextrusion material is available from Raven Industries, Sioux Falls, S. Dak.

It is found advantageous to construct the bag from materials which will be resistant to punctures, tears, and scuffs. Further, it is found advantageous to use a material which is conducive to adding printed indicia on the exterior of the bag. For example, in certain preferred arrangements, the bags include indicia expressly showing where the bag is to be picked up and handled. This may include, for example, a colored mark such as arrows, rectangles, or other indicia at the ends of the bag to show where the bag may most easily be grasped. Other indicia may include arrows or other marks highlighting the perforation strip so that the passenger, when claiming his luggage, can easily identify where it is he is to rip the bag in order to access his luggage. The indicia may be designed with a variety of colors and patterns which, in combination with the structure of the bag, may provide a particularly ornamental or attractive appearance. The material for the bag is also most preferably made from a combination of recycled and virgin materials, and is recyclable itself.

The adhesive region may be made from a variety of materials, so long as it provides the function of enabling a secure and tamper-evident seal at the closure arrangement. In the preferred embodiment, the adhesive region includes the adhesive strip, which may take the form of double stick tape. For example, one preferred adhesive includes a double coated clear polypropylene film tape having a 100% plastic film release liner. One such preferred double stick tape is Product 536 Polypropylene-Plastic Liner available from International Tape Company of Windham, N.H.

In accordance with the invention, the invention includes a method for constructing a flexible bag. As embodied herein, one method for constructing the flexible bag of the type illustrated in the FIGS. includes, as a first step, providing a film of a polymeric material. This polymeric film preferably is an extruded high density polyethylene, or low density polyethylene. In other preferred arrangements, the film is provided by coextruding to provide a dual slip surface. The coextrusion may include multiple layers, with the most inner layer having a relatively low coefficient of friction in order to allow luggage to easily slip in and out of the bag, and the most outer layer having a high coefficient of friction to provide a desirable and advantageous gripping surface for baggage handlers. Layers in between the inner most and outer most layer may be coextruded from either virgin or recycled polyethylene. The film which is extruded has first and second edges which are generally parallel to each other.

Next, the film is folded over itself in order to form first and second opposed panel sections and a gusset region in between the first and second panel sections. Preferably, the first panel section is longer than the second panel section at an extended region. One preferred way of providing this extended region is by cutting the second panel section to remove a portion at the end and, thus, result in the first panel section being longer.

Next, the extended region of the first panel section is folded into a flap arrangement. For example, if constructing a bag resembling the bag illustrated in the FIGS., the extended region is folded into an accordion form to form first, second, and third flaps folded over each other.

Next, an adhesive region is provided on the bag for providing a secured seal. One way of accomplishing this step is by applying an adhesive strip, such as a double stick tape, on the second panel section from the first end to the second end. This step of providing an adhesive strip may include, in some preferred arrangements, applying a colored strip to the bag, based upon the overall dimensions of the bag.

Next, the first and second panel sections are heat sealed together along the first and second edges. This also includes heat sealing the first, second, and third flaps at their respective ends to the first and second edges at first and second seal regions.

Next, the film is provided with a perforation line, by cutting a series of small breaks across the length of the film.

After the bag is constructed in this manner, the bag may be stored in a suitable storage arrangement. For example, in some embodiments, the bag may be stored on a roll. Other bags would be rolled on top of each other, to result in one large roll of bags. In other embodiments, the bags are stored in a box. The bags are stacked on top of each other in the box, and are accessed from a dispenser box.

An example of one preferred bag has the following dimensions: a length from first end to second end (top to bottom) of 27"; a width from first edge to second edge of 34"; a flap arrangement from the top of the bag to the bottom edge of the flaps of 4"; a distance of 2" from the top end of the bag to the adhesive strip; a width of adhesive strip of 1"; a gusset having a width of 8"; and a volume capacity of about 2.4 cubic feet.

It should be understood that other sizes of the bag can be used and are advantageous depending upon the particular application. It is also noted that the gusset does not necessarily have to be at the end opposite to the closure arrangement. Rather, the gusset can be along the sides. Furthermore, both of the sides can include gussets in addition to the bottom gusset. Other mechanisms for aiding the opening of the bag are envisioned, such as tear beads.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A flexible bag for protecting luggage, the bag comprising:

(a) first and second opposing panel sections joined by a gusset at a first end;

(b) the first and second panel sections being secured together along first and second opposite edges with the gusset therebetween, to form a containment region between the first and second panel sections and bordered by the first and second edges and the gusset;

(c) a mouth defined by the first and second panel sections at a second end opposite to the first end;

(i) the mouth being movable from an open position to a closed position;

(ii) the mouth providing access to the containment region when in the open position;

(d) a closure arrangement at the mouth for securing the mouth in the closed position, the closure arrangement including:

(i) an adhesive region held by the second panel section; the adhesive region including an adhesive strip extending between first and second seal regions; and (ii) a flap arrangement integral to the first panel section; the flap arrangement including a plurality of flaps sealed to the first and second edges at the first and second seal regions: the flap arrangement being constructed and arranged to:

fold over the mouth;

engage the adhesive region; and completely secure the mouth in the closed position closing all access voids to the containment region, and completely enclose the first and second seal regions and the adhesive strip; and (e) a perforated line in at least one of the first and second panel sections, and extending at least partially between the first and second edges.

2. A flexible bag according to claim 1, wherein:

(a) the perforated line is in the first panel section adjacent to the flap arrangement, and extends the length between the first and second edges.

3. A flexible bag according to claim 1, wherein:

(a) the first and second panel sections and closure arrangement comprise high density polyethylene.

4. A flexible bag according to claim 1, wherein:

(a) the first and second panel sections and closure arrangement comprise low density polyethylene.

5. A flexible bag according to claim 1, wherein:

(a) the first panel section comprises a single layer; and (b) the second panel section comprises a single layer.

6. In combination, luggage and a disposable, tamper-evident flexible bag for protecting the luggage, the combination comprising:

(a) a piece of luggage; and (b) a bag including:

(i) first and second opposing panel sections joined by a gusset at a first end;

(ii) the first and second panel sections being sealed together along first and second opposite edges with the gusset therebetween, to form a containment region between the first and second panel sections and bordered by the first and second edges and the gusset; the containment region holding the luggage between the first and second edges and over the gusset;

(iii) a mouth defined by the first and second panel sections at a second end opposite to the first end; the mouth being in a closed position; and (iv) a closure arrangement at the mouth sealing the mouth in the closed position, the closure arrangement including: an adhesive region held by the second panel section including an adhesive strip extending between first and second seal regions; and a flap arrangement integral to the first panel section; the flap arrangement including a plurality of flaps sealed to the first and second edges at the first and second seal regions; the plurality of flaps being folded over the mouth and engaged with the adhesive region to completely enclose the first and second seal regions and the adhesive strip to seal the mouth in the closed position closing all access voids to the containment region and the luggage.

7. A combination according to claim 6, further including:

(a) a perforated line in at least one of the first and second panel sections, and extending at least partially between the first and second edges.

8. A combination according to claim 6, wherein:

(a) the adhesive strip extends an entire length between the first and second seal regions.

9. In combination, luggage and a disposable, tamper-evident flexible bag for protecting the luggage, the combination comprising:

(a) a piece of luggage; and (b) a bag including:

(i) first and second opposing panel sections joined by a gusset at a first end;

(ii) the first and second panel sections being sealed together along first and second opposite edges with the gusset therebetween, to form a containment region between the first and second panel sections and bordered by the first and second edges and the gusset; the containment region holding the luggage between the first and second edges and over the gusset;

(iii) a mouth defined by the first and second panel sections at a second end opposite to the first end; the mouth being in a closed position;

(iv) a closure arrangement at the mouth sealing the mouth in the closed position, the closure arrangement including: an adhesive region held by the second panel section; and a flap arrangement integral to the first panel section; the flap arrangement being folded over the mouth and engaged with the adhesive region to completely seal the mouth in the closed position closing all access voids to the containment region and the luggage;

(v) the adhesive region including an adhesive strip on the second panel section, the adhesive strip: extending the entire length between the first and second edges; being located a first distance from the second end of the bag to define a band between the strip and the second end; and extending between first and second seal regions; and (vi) the flap arrangement including first, second, and third flaps joined together at first, second, and third fold lines and completely enclosing: the first and second seal regions; the band; and the adhesive strip, thereby preventing access to the luggage.

10. A combination according to claim 9, further including:

(a) a perforated line in at least one of the first and second panel sections, and extending at least partially between the first and second edges.

11. A method for protecting luggage comprising the steps of:

(a) providing a bag including a containment region and a mouth providing access to the containment region; the bag also including a perforation line;

(b) placing a piece of luggage in the containment region of the bag by passing the luggage through the mouth;

(c) completely sealing the mouth in a closed position to close all access voids to the containment region, and thereby prevent access to the luggage;

(d) tearing along the perforation line in order to access the luggage; and (e) disposing of the bag.

12. A method for protecting luggage according to claim 11, wherein:

(a) the step of providing a bag includes providing a bag including:

(i) first and second panel sections sealed together along first and second edges;

(ii) a plurality of flaps sealed to the first and second edges at first and second seal regions;

(iii) an adhesive strip extending between the first and second seal regions; and (b) the step of completely sealing the mouth includes folding the plurality of flaps over the mouth to engage the adhesive strip and completely enclose:

(i) the first and second seal regions; and (ii) the adhesive strip.

13. A method for protecting luggage comprising the steps of:

(a) providing a bag including a containment region and a mouth providing access to the containment region; the bag also including:

(i) first and second panel sections sealed together along first and second edges;

(ii) a plurality of flaps sealed to the first and second edges at first and second seal regions;

(iii) an adhesive strip extending between the first and second seal regions;

(b) placing a piece of luggage in the containment region of the bag by passing the luggage through the mouth;

(c) completely sealing the mouth by folding the plurality of flaps over the mouth to engage the adhesive strip and completely enclose:

(i) the first and second seal regions; and (ii) the adhesive strip.

14. A method according to claim 13, wherein:

(a) the step of providing a bag includes providing a bag including a perforation line;

and further including the step of:

(b) after the step of completely sealing the mouth, tearing along the perforation line in order to access the luggage.

* * * * *